US008904564B2

(12) United States Patent
Laycock et al.

(10) Patent No.: US 8,904,564 B2
(45) Date of Patent: Dec. 9, 2014

(54) HAND COVERING AND GARMENT COMBINATION

(76) Inventors: Lisa Laycock, Alpine, UT (US); Lacey Laycock Chase, Alpine, UT (US); Larry R. Laycock, Alpine, UT (US)

( * ) Notice: Subject to any disclaimer, the term of this patent is extended or adjusted under 35 U.S.C. 154(b) by 206 days.

(21) Appl. No.: 13/045,927

(22) Filed: Mar. 11, 2011

(65) Prior Publication Data

US 2012/0227153 A1 Sep. 13, 2012

(51) Int. Cl.

| | |
|---|---|
| ***A41D 1/00*** | (2006.01) |
| ***A41D 3/02*** | (2006.01) |
| ***A41D 27/10*** | (2006.01) |
| ***A41D 19/00*** | (2006.01) |
| *A41D 3/00* | (2006.01) |

(52) U.S. Cl.

CPC ..... *A41D 19/0041* (2013.01); *A41D 27/10* (2013.01); *A41D 3/00* (2013.01)

USPC ..... 2/94; 2/93; 2/270

(58) Field of Classification Search

USPC ..... 2/86, 93, 94, 87, 97, 100, 270, 160

See application file for complete search history.

(56) References Cited

U.S. PATENT DOCUMENTS

| | | | | | |
|---|---|---|---|---|---|
| 2,136,879 | A | * | 11/1938 | Haber et al. | 2/270 |
| 2,226,066 | A | * | 12/1940 | Moe | 2/270 |
| 2,274,510 | A | * | 2/1942 | Wohl et al. | 2/270 |
| 3,193,842 | A | * | 7/1965 | Bell | 2/94 |
| 3,214,771 | A | * | 11/1965 | Treiber | 2/270 |
| 3,675,391 | A | * | 7/1972 | Gallacher | 95/52 |
| 4,773,100 | A | * | 9/1988 | Kuo | 2/46 |
| 5,950,240 | A | * | 9/1999 | Carpenter et al. | 2/160 |
| 6,253,381 | B1 | * | 7/2001 | Kelley | 2/125 |
| 7,296,302 | B2 | * | 11/2007 | DeLorenzo et al. | 2/84 |
| 7,519,192 | B1 | * | 4/2009 | Laycock et al. | 381/301 |
| 2001/0025384 | A1 | * | 10/2001 | Kester | 2/89 |
| 2009/0064400 | A1 | * | 3/2009 | Garrigos | 2/458 |
| 2012/0060256 | A1 | * | 3/2012 | Parker | 2/85 |

FOREIGN PATENT DOCUMENTS

| | | | | | |
|---|---|---|---|---|---|
| FR | 2232280 | A | * | 2/1975 | |
| GB | 2253776 | A | * | 9/1992 | A41D 3/00 |
| GB | 2459096 | A | * | 10/2009 | A41D 3/02 |

* cited by examiner

*Primary Examiner* — Alissa L Hoey
*Assistant Examiner* — Jameson Collier
(74) *Attorney, Agent, or Firm* — Maschoff Brennan

(57) ABSTRACT

The present invention provides for various embodiments of a hand covering and garment combination. The hand covering and garment combination includes at least one glove and a garment having at least one sleeve. A compartment can be located within an inner liner of the sleeve. The compartment can be configured to selectively receive and store the glove. An attachment element can be configured to selectively secure the glove to the sleeve. The attachment element can have a first end attached to the sleeve and a second end attached to a fastener. The fastener can selectively fasten and unfasten the glove to the attachment element. Finally, a retractable dial can be coupled to the sleeve, wherein a portion of the attachment element travels through the retractable dial. The retractable dial can be configured to selectively retract at least a portion of the first end of the attachment element.

7 Claims, 6 Drawing Sheets

HAND COVERING AND GARMENT COMBINATION

CROSS-REFERENCE TO RELATED APPLICATIONS

Not applicable.

BACKGROUND OF THE INVENTION

1. The Field of the Invention

The present invention relates generally to articles of clothing. More particularly, embodiments of the invention relate to hand covering and garment combinations.

2. The Relevant Technology

In cool, cold and inclement weather, it is customary to wear a sweater, sweatshirt, jacket, coat, cape, poncho, or similar garment to ward off the cold and to protect oneself from rain and snow. In most instances, it is also desirable to wear mittens or gloves. However, people do not always remember to take their mittens or gloves with them and the same are frequently lost or misplaced. When people do remember their mittens or gloves, they have, for years, tried to carry and store them in a bag, a pant pocket, or a coat pocket. This can take up valuable storage space, be uncomfortable, and make the bag and clothing appear bulky and awkward. People also regularly struggle with their bags and pockets in order to successfully access and retrieve their mittens or gloves. This is particularly dangerous where safety is a concern, such as when people are driving, working, or performing other tasks that require an individual's attention or the use of hands.

In addition to wearing mittens or gloves for protection, people often wear mittens or gloves for a fashion look. A fashion look can normally be achieved where there is a material, design, or fashion match between the mittens or gloves and the coat or jacket, or like garment. However, conventional mittens or gloves rarely match a jacket or coat and when they do, the mittens or gloves are frequently lost, forcing the individual to either go without hand protection or ruin their fashion look with mismatching mittens or gloves.

Some systems for preventing glove loss have been developed. However, these systems are awkward and unfashionable. Existing systems also provide the wearer limited flexibility and control over any connection between the garment and the mittens or gloves. Other systems have been developed for glove storage on a jacket or coat. However, these systems are bulky, inconvenient, and uncomfortable for a user.

BRIEF SUMMARY OF THE INVENTION

The present invention relates to a hand covering and garment combination. Embodiments of the invention disclose various techniques for facilitating use of hand coverings, such as mittens or gloves, by selectively securing the hand coverings to a garment of a user, and by providing comfortable, convenient and discrete storage of the hand coverings on the garment. In one exemplary embodiment, the combination can include a hand covering and a garment configured to cover at least a portion of the upper torso of a user. The garment may have a compartment that is sized, shaped and configured to selectively receive and store the hand covering. The garment may also have an attachment element that has a first end attached to the garment and a second end attached to the hand covering. By attaching the attachment element to the hand covering, a user is able to secure his or her hand covering the garment. In addition to securing the hand covering to the garment, the user is also able to conveniently store the hand covering in the compartment because the attachment element can retract the hand covering into the compartment during non-usage.

The present invention also relates to a hand covering and garment combination that can have at least one glove and a garment having at least one sleeve attached to a body portion. The garment may include a compartment discretely located within an inner liner in the sleeve. The compartment may be configured to store the glove. The compartment may have an opening located near a free end of the sleeve. The opening may have a closure element that can be selectively opened and closed. The combined hand covering and garment may also include an attachment element that is configured to selectively secure the glove to the sleeve. The attachment element may have a first end connected to the sleeve and a second end with a fastener that can selectively fasten and unfasten the glove to the attachment element. The garment may also include a retractable dial that is configured to retract the glove into the compartment during non-usage and adjust the length of the attachment element by selectively retracting at least a portion of the attachment element.

In one exemplary embodiment, an article of clothing includes a first glove and a garment. The garment may have a body portion and a first sleeve. The first sleeve may have a first end attached to the body portion and a second free end. The garment may further include a first compartment positioned near the free end of the first sleeve. The first compartment may be configured to selectively receive and store the first glove during non-usage. The first compartment may have an opening that has a closure element located adjacent the free end of the first sleeve. The closure element can be selectively opened and closed. The garment may also include a first attachment element. The first attachment element may have a first end operatively attached to the first sleeve and a second end attached to the first glove. Finally, the garment may have a retractable dial that is concealed within the first compartment. A portion of the first attachment element can travel through the retractable dial such that the first retractable dial selectively retracts at least a portion of the first attachment element.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION

Figure 1:
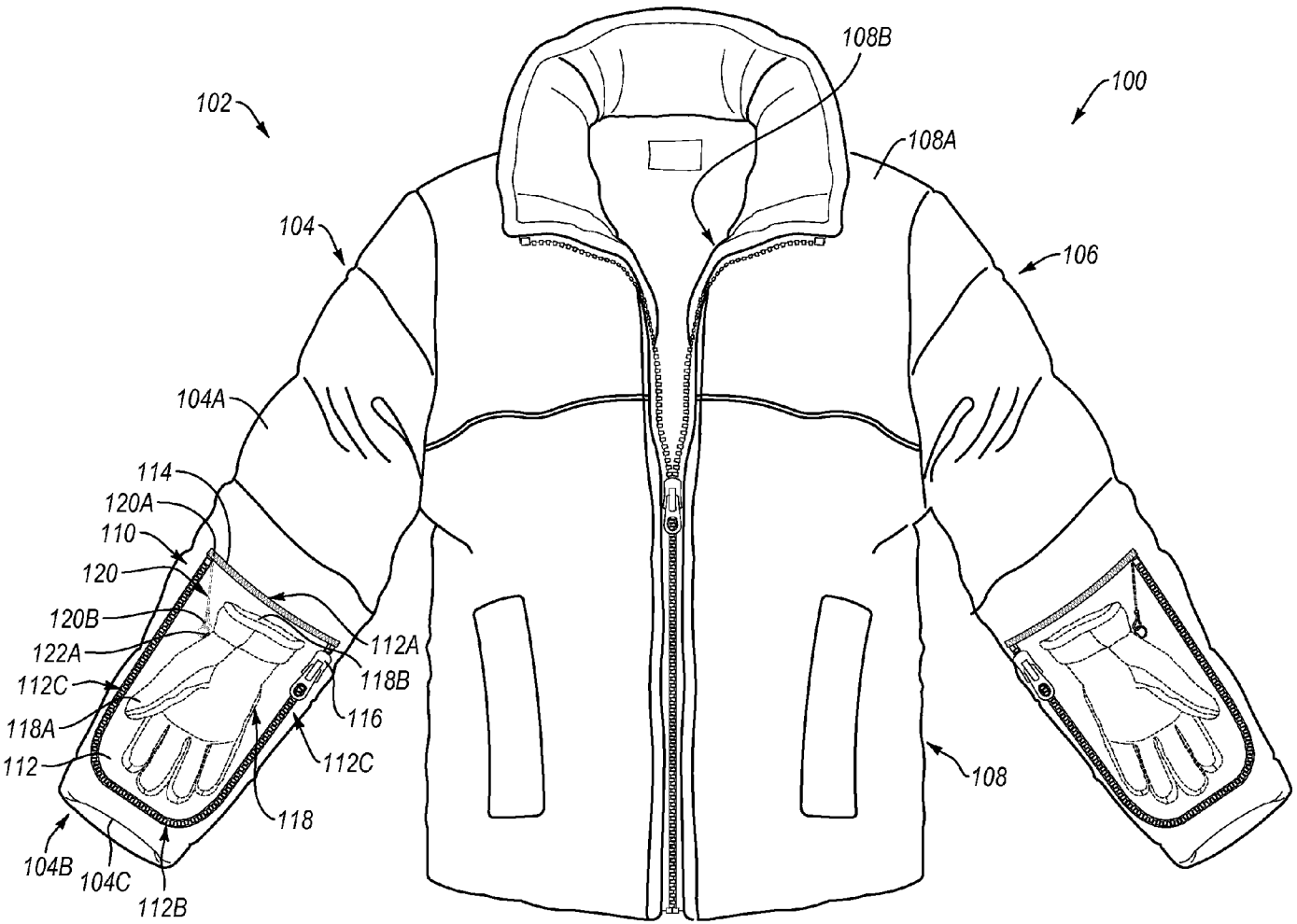
FIG. 1 illustrates a hand covering and garment combination according to one example.

FIG. 1 illustrates a hand covering and garment combination 100, in accordance with one embodiment of the present invention. In one embodiment, the hand covering and garment combination 100 may include at least one hand covering or glove 118, and a garment 102. The garment 102 may comprise sleeves 104, 106 attached to a body portion 108. The body portion 108 may include an outer or exterior surface 108A and an inner or interior surface 108B. While features of a single sleeve 104 are discussed, it will be appreciated that the discussion the sleeve 104 can be equally applicable to the features of the sleeve 106. The sleeve 104 may include an outer or exterior surface 104A, an inner or interior surface 104B, and distal or free end 104C. A compartment 110 configured to selectively receive and store the glove 118 may be located on the exterior surface 104A of the sleeve. The sleeve 104 may include an attachment element or tether 120 having an elongate body with a first end 120A attached to the sleeve 104 and a second end 120B attached to the glove 118. The tether 120 may be configured to secure the glove 118 to the sleeve 104 and to retract the glove 118 into the compartment 110 during non-usage. Although garment 102 is portrayed as a coat, garment 102 may include any number of articles of clothing configured to be worn over at least a portion of a user's torso and/or arms, including, but not limited to, sweatshirts, jackets, sweaters, coats, shawls, capes, ponchos, arm warmers, and the like.

As shown in FIG. 1, the compartment 110 may be positioned near the free end 104C of the sleeve 104 and sized, shaped, and configured to selectively conceal and store the glove 118. Of course, the compartment 110 may store other items as well, such as money, keys, hygiene devices, and the like. The compartment 110 may be formed between a cover portion 112 and the exterior surface 104A of the sleeve 104. In one embodiment, the cover portion 112 may have a substantially rectangular shape and include an upper edge 112A, a lower edge 112B, and two side edges 112C. The material of the cover portion 112 can be similar or identical to the exterior surface 104A of the sleeve 104 such that the compartment 110 substantially blends into the sleeve. The cover portion 112 can be attached to the exterior surface 104A of the sleeve 104 by stitching 114 along the upper edge 112A and a zipper 116 extending from one side edge 112C, along the lower edge 112B, to the other side edge 112C of the cover portion 112. The zipper 116 may also function as a closure element configured to open and close the compartment 110. To open the compartment 110, the zipper 116 can be unzipped along a portion of the side edges 112C and/or the lower edge 112B of the cover portion 112, at least partially disengaging the cover portion 112 from the exterior surface 104A of the sleeve 104. To close the compartment 110, the cover portion 112 can be re-zipped to a closed position. The positioning and configuration of the compartment 110 on the exterior surface 104A of the sleeve 104 can allow the compartment 110 to be easily accessible and fashionably concealed. The design of the compartment 110 also can allow a user to securely and discretely store his or her glove 118 in the compartment 110.

While the compartment 110 is shown located on the exterior surface 104A of the sleeve 104, the compartment 110 may be positioned in any location suitable to store and conceal the glove 118 such as on the interior surface 104A of the sleeve 104, between the exterior surface 104A and the interior surface 104A of the sleeve 104, or on the exterior surface, the interior surface, or between the exterior and interior surfaces of a garment 102 without sleeves such as a poncho or shawl. In addition, while the cover portion 112 of the compartment 110 is shown being secured to the exterior surface 104A of the sleeve 104 by stitching 114 and zipper 116, other means suitable to attach the cover portion 112 to the sleeve 112 are possible such as adhesive, buttons, snaps, Velcro® (a hook and loop type closure system), clasp, or the like. Furthermore, while the zipper 116 is shown opening and closing the compartment 110, other closure elements are possible such as a folded fabric overlap, Velcro®, buttons, a clasp, or snaps. Likewise, although the compartment 110 is shown having a substantially rectangular shape, any shape suitable to store and conceal the glove is possible such as a square, trapezoidal, or oval shaped compartment.

The glove 118 may be sized, shaped and configured such that at least a portion of the glove 118 can be selectively stored and concealed within the compartment 110. The glove 118 may have a hand portion 118A and a cuff portion 116B. The glove 118 can be stored with the hand portion 118A nearest the free end 104C of the sleeve 104. In another embodiment, the glove 118 can be stored with the cuff portion 118B nearest the free end 104C of the sleeve 104. While the glove 118 is shown, other hand coverings are possible such as mittens, fingerless hand wear, muffs, protective hand wear and the like. In one embodiment, unwanted movement of the glove 118 within the compartment 110 may be minimized by selectively securing the glove 118 within the compartment 110. For example, a first magnet (not shown) may be attached within the compartment 110 near the upper edge 112A of the cover portion 1112. A second magnet (not shown) may be attached to the cuff portion 118B of the glove 118. When the glove 118 is stored within the compartment 110, the first magnet and second magnet can be drawn together to secure the glove 118 within the compartment 110.

The 120 may be configured to secure the glove 118 to the sleeve. As shown, the tether 120 may the first end 120A attached to the exterior surface 104A of the sleeve inside of the compartment 110 and the second end attached to the glove 118 via a tether hook 122A. While the tether 120 is shown, other attachment elements may be employed such as a string, fabric, a line, lace, a cord, a cable, a wire, or any other means suitable to secure the glove 118 to the sleeve 104. The tether 120 can be attached to the sleeve 104 by stitching, buttons, snaps, Velcro®, or any other means suitable to attach the tether 120 to the sleeve 104. The tether 120 can also be permanently or detachably attached to the sleeve 104. When the glove 118 is stored within the compartment 110, the tether 120 can be substantially concealed within the compartment 110. When the glove 118 is removed from the compartment, only a portion of the tether 120 between the cuff portion 118B of the glove 118 and the lower edge 112C of the cover portion 112 may be exposed (not shown in FIG. 1). FIG. 1 shows the second end 120B of the tether 120 being attached to the cuff portion 118B on an exterior surface of the glove 118 via the tether hook 122A. In another embodiment, the second end 120B of the tether 120 can be attached to an interior surface of the glove 118. The tether hook 122A may be selectively attached to a loop 122B on the cuff portion 118A of the glove 118. While the tether hook 122A and corresponding loop 122B are shown, stitching, buttons, snaps, Velcro®, clips, magnets, or any other means suitable to attach the tether 120 to the glove 118 are possible. The glove 118 may be permanently attached to the tether 120 or detachably attached to the tether 120. In the case of the permanently attached glove 118, the glove 118 can configured to provide a fashion match between the glove 118 and the garment 102. For example, the glove 118 and the garment 102 may include the same design or comprise the same material and color. In the case of a detachable glove 118, the fashion match between the glove 118 and the garment 102 can be customizable based on the preferences of the user. In addition, the user can remove the glove 118 to be cleaned separate from the garment 102, but still have the glove 118 conveniently stored and accessible. Accordingly, the securement of the glove 118 to the sleeve 104 may be virtually unnoticeable and versatile.

The tether 120 may also be configured to permit the glove 118 to be removed for use from the compartment 110 and to retract the glove 118 into the compartment 110 for storage during non-usage. In one embodiment, the tether 120 may have elastic properties such that the tether 120 may move between a first position wherein the tether 120 and attached glove 118 are positioned within the compartment 110 and a second position wherein the attached glove 118 and at least a portion of the tether 120 are extended and positioned below the sleeve 104. The tether 120 may be configured such that the tether is self-biased to move toward the first position with and/or without the glove 118 attached. Such a configuration allows a user to conveniently and effortlessly store the glove 118 in the garment 102. For example, a user can move the tether 120 from the first position to the second position by pulling the glove 118 from the compartment 110 and placing the glove 118 on the user's hand. When the user is finished using the glove 118, the user can remove the glove 118 from the user's hand, and the tether 120 may pull the glove 118 into the compartment 110 by returning to its first position. The elasticity of the tether 120 can also allow a user to maintain a comfortable range of motion with the glove 118 on the user's hand as the tether 120 stretches with movement of the user's arm and hand.

While the elasticity of the tether 120 is described as retracting the glove 118 into the compartment 110, other means to retract the glove 118 into the sleeve 104 are possible. For example, the tether 120 may travel through a retractable dial (shown in FIG. 2) that is configured to retract at least a portion of the tether 120 and glove 118 into the compartment 110. The retractable dial may be positioned within the compartment 110 such that the retractable dial is completely concealed when the compartment 110 is closed, but accessible when the compartment 110 is open.

When a user desires to wear the glove 118, the zipper 116 can be unfastened and the glove 118 and a portion of the tether 120 can be pulled out of the compartment 110. In the extended position, the glove 118 can hang down below the free end 104C of the sleeve 104 ready to receive a hand therein. In order to replace the glove 118 in the compartment 110, the user can remove the glove 118 from the user's hand and the tether 120 can retract the glove 118 into the compartment 110. The zipper 116 can then be zippered to close the compartment 110 and secure the glove 118 in the storage position which provides a discrete and fashionable appearance. While a single zipper 116 is shown, a double zipper or the like is also possible.

Figure 2A:
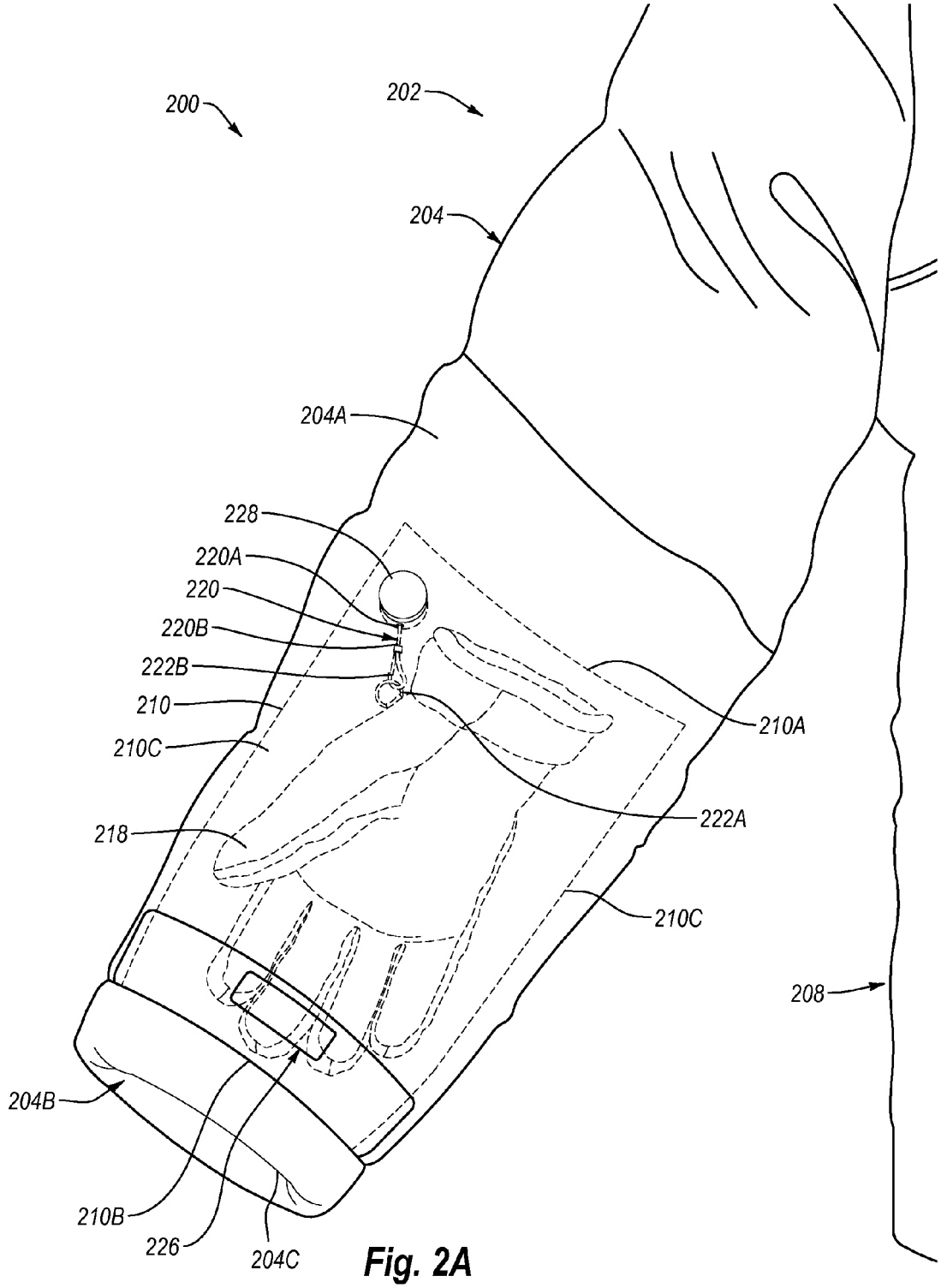
FIG. 2A illustrates a hand covering and garment combination according to another example.

Reference is now made to FIG. 2A which illustrates an additional example hand covering and garment combination 200. The hand covering and garment combination 200 may be similar in many respects to the hand covering and garment combination 100 previously described above in FIG. 1. To the extent features or components of this configuration function in a manner similar to that described above, such disclosure is hereby incorporated into the following additional configuration. Like structures and/or components are given like reference numerals. Additionally, the hand covering and garment combination 200 may incorporate at least one component of the hand covering and garment combination 100 described in FIG. 1.

As shown in FIG. 2A, the hand covering and garment combination 200 may include a glove 218 and garment 202 comprising a sleeve 204 attached to a body portion 210. As discussed above, while features of a single sleeve 204 are discussed, it will be appreciated that the discussion of the features of the sleeve 204 can be equally applicable to the features of second sleeve (not shown). The sleeve 204 may include an outer layer 204A, an inner liner 204B, and a distal or free end 204C. The garment 202 may include a compartment 210 having a downward facing opening 224 located within the inner liner 204B of the sleeve 204. The compartment 210 may be configured to selectively receive and store the glove 218. The sleeve 204 may include an attachment element or cord 220 configured to attach the glove 218 to the sleeve 204. The sleeve 204 may also include a retractable dial 228 configured to retract the cord 220 and the glove 218 into the compartment 210 during non-usage.

As shown, the compartment 210 may be formed between the outer layer 204A and the inner liner 204B and be located near the free end of the sleeve 204. The shape and size of the compartment 210 may be defined by an upper boundary 210A, a lower boundary 210B adjacent the free end 204C of the sleeve, and two side boundaries 210C. In another embodiment, the compartment 210 may extend along the entire length or a substantial portion of the sleeve 204. While the compartment 210 is shown formed between the outer layer 204A and the inner liner 204B, the compartment 210 may comprise a separate pouch or pocket located on the outer layer 204A or the inner liner 204B of the sleeve 204, or any other suitable compartment design. The downward facing opening 224 of the compartment 210 may be positioned along the lower boundary 210B of the compartment 210. While the opening 224 is shown located on the lower boundary 210B, the opening 224 may be located on the upper boundary 210A, the side boundaries 210C of the compartment 210, or any other location suitable to provide access to the glove 218.

Figure 2B:
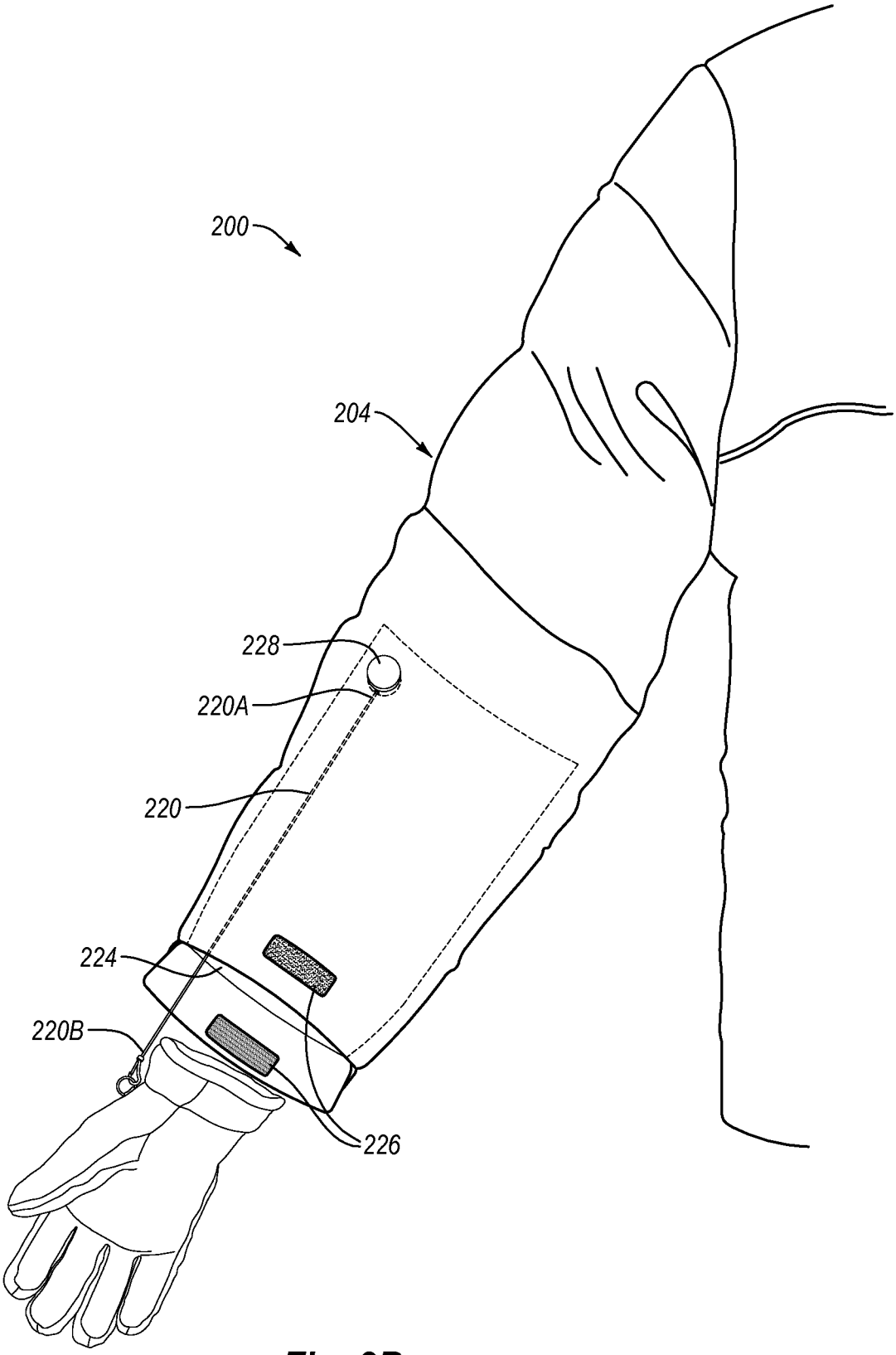
FIG. 2B illustrates the hand covering and garment combination shown in FIG. 2A with the glove removed from the sleeve.

The opening 224 may include a closure element or a folded fabric overlap and Velcro® strip 226 configured to selectively open and close the opening 224. As shown in FIG. 2A, the folded fabric overlap and Velcro® strip 226 can be folded to close the opening 224 and conceal the glove 218 within the compartment 210. As shown in FIG. 2B, the folded fabric overlap and Velcro® strip 226 can be unfolded to open to opening 224 so that a user can access the compartment 210 and pull out the glove 218. Closure elements other than the folded fabric overlap and Velcro® strip 226 may be employed such as, for example, a button, a clasp, a zipper, a snap, or any other means suitable to selectively open and close the opening 224.

As shown in FIG. 2A, the cord 220 may have a first end 220A operatively attached to the sleeve 204 and a second end 220B attached to the glove 218. The cord 220 may be attached via the retractable dial 228 that may be attached to the sleeve 204. In another embodiment, the cord 220 may be attached directly to the sleeve 204. The cord 220 may be permanently or detachably attached to the sleeve 204. For instance, the cord 220 may be attached by stitching, buttons, snaps, Velcro®, or any other means suitable to permanently or detachably attach the cord to the sleeve. While the second end 220B of the cord 220 is shown fastened to the glove 218 via a loop 222A and a clip 222B assembly, the cord 220 may be fastened to the glove using buttons, snaps, stitching, Velcro®, magnets or the like. The cord 220 may also be substantially concealed within the sleeve 204 by attaching and positioning at least a portion of the cord 220 between the outer layer 204A and the inner liner 204B. The second end 220B of the cord 220 may be attached to an exterior surface or an interior surface of the glove 218.

As shown, the retractable dial 228 may extend through the outer layer 204A into the space between the outer layer 204A and the inner liner 204B, being exposed and accessible on the outside of sleeve 204. In another embodiment, the retractable dial 228 may extend through the inner liner 204B of the sleeve into the space between the outer layer 204A and the inner liner 204B, being exposed and accessible on the inside of the sleeve 204. In yet another embodiment, the retractable dial 228 may be located on the outer layer 204A or the inner liner 204B. The retractable dial 228 may be permanently connected to the outer layer 204A of the sleeve 204 or detachably connected. The retractable dial 228 may be attached to the sleeve 204 by stitching, adhesive, snaps, buttons, Velcro®, or any other means suitable to attach the retractable dial 228 to the sleeve.

The retractable dial 228 may configured such that a portion of the cord 220 can travel through the dial. More specifically, at least the first end 220A of the cord 220 can travel through the retractable dial 228. The retractable dial 228 may be further configured to selectively retract at least a portion of the cord 220. In other words, a user can operate retractable dial 228 to draw a part of the cord 220 into the dial, thus decreasing the length of the exposed cord 220, or the user can extend the length of the cord 220 by pulling the cord 220 out of the retractable dial 228. In the same way, the user can operate retractable dial 228 to retract the glove 218 into the compartment 210 or remove the glove 218 from the compartment 210. The retractable dial 282 can be controlled by buttons, switches, knobs, or any other suitable control mechanism.

One technique for retracting the cord 220 is to include a spring-load mechanism within the retractable dial 228 so that the dial is under constant tension. By pressing a button or other control mechanism, the cord 220 automatically retracts into retractable dial 228. The user may simply pull at the cord 220 to slide the cord 220 out of retractable dial 228 in order to lengthen the cord 220.

In another embodiment, the second sleeve (not shown) may have an identical second compartment and second glove. An elongate internal passageway may extend from retractable dial 228 up sleeve 204 across the body 202 and down the second sleeve to the second compartment. A second cord may have a first end attached to the second glove. The second cord may be sized and configured to extend from the second glove through the internal passageway to the retractable dial 228 such that a second end and a least a portion of the second cord travels through the retractable dial 228. Accordingly, the retractable dial 228 may be configured such that a user may operate the retractable dial 228 to control both the glove 218 and the second glove.

FIG. 2B shows the hand covering and garment combination 200 with the glove 218 out of the compartment 210 and extended from the sleeve 204. When a user desires to wear the glove 218, the folded fabric overlap and Velcro® strip 226 can be unfolded and the glove 218 and a portion of the cord 220 can be pulled out of the downward facing opening 224. The user can then place the glove 218 on the user's hand. During non-usage, the user can operate the retractable dial 228 to draw the cord 220 and the glove 218 into the compartment 210. The folded fabric overlap and Velcro® strip 226 can then be re-folded to close the compartment 210 and secure the glove 218 in a storage position. Such a configuration allows the user to conveniently access, use, secure and store the glove 218.

Figure 3:
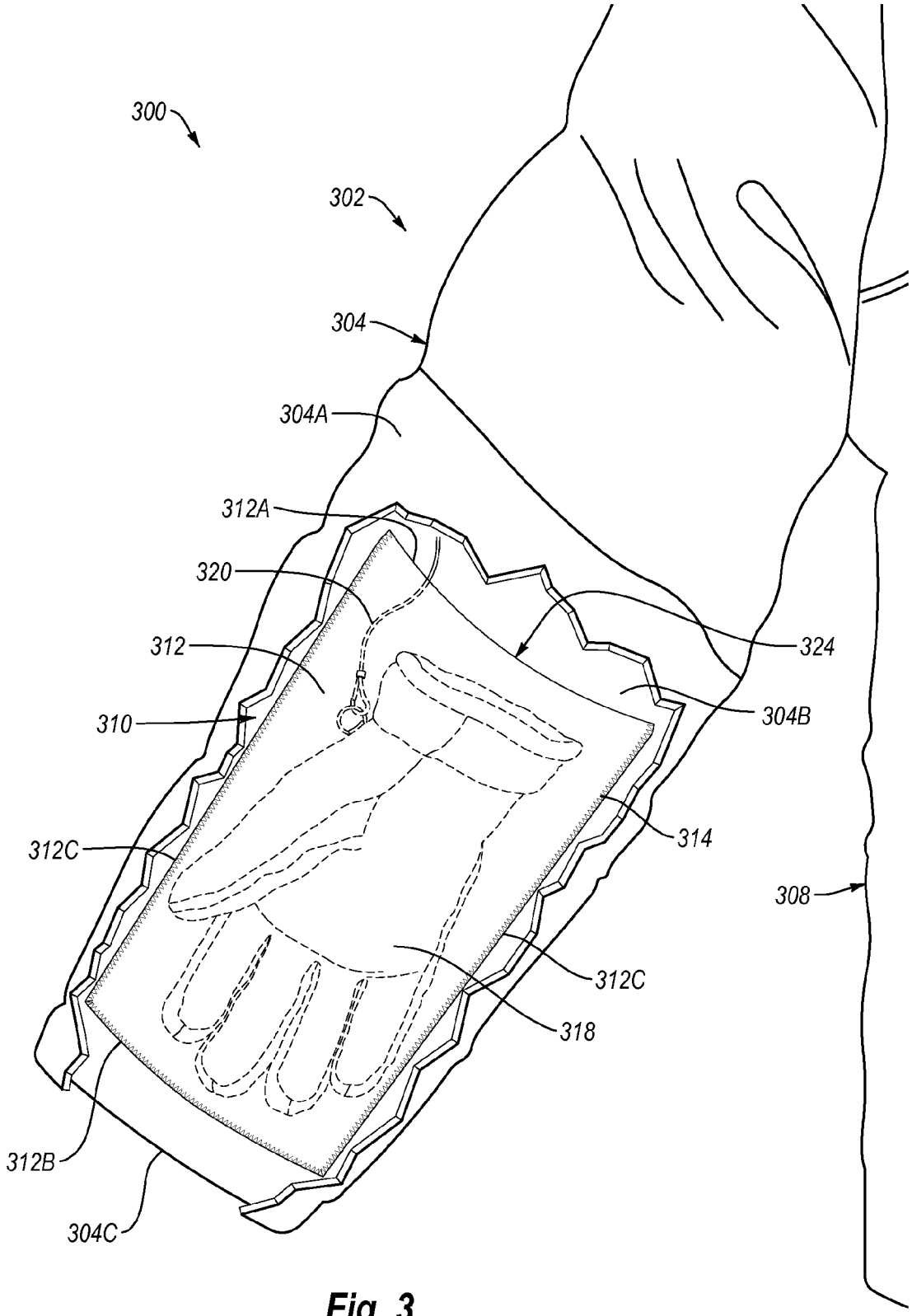
FIG. 3 illustrates a cut away view of a sleeve and compartment in accordance with yet another example of a hand covering and garment combination.

Reference is now made to FIG. 3 which shows a cut away view of an additional example hand covering and garment combination 300. The hand covering and garment combination 300 may be similar in many respects to the hand covering and garment combinations 100 and 200 previously described above in FIGS. 1 and 2. To the extent features or components of this configuration function in a manner similar to that described above, such disclosure is hereby incorporated into the following additional configuration. Like structures and/or components are given like reference numerals. Additionally, the hand covering and garment combination 300 may incorporate at least one component of the hand covering and garment combinations 100 and/or 200 described in FIGS. 1 and 2.

As shown in FIG. 3, the hand covering and garment combination 300 may include a garment 302 comprising a sleeve 304 attached to a body portion 306. As discussed above, while features of a single sleeve 304 are discussed, it will be appreciated that the discussion of the features of the sleeve 304 can be equally applicable to the features of a second sleeve (not shown). The sleeve 304 may include an exterior or outer surface 304A, an interior or inner surface 304B, and a distal or free end 304C. The garment 302 may include a compartment 310 located on the interior surface 304B of the sleeve 304. The compartment 310 may have an upward facing opening 324. The compartment 310 may be configured to selectively receive and store the glove 318. The sleeve 204 may include an attachment element or string 320 configured to attach the glove 318 to the sleeve 304 and to retract the glove 318 into the compartment 310 during non-usage.

As shown, the compartment 310 may be positioned near the free end 304C of the sleeve 304 and be formed between a cover portion 312 and the interior surface 304B of the sleeve 304. The cover portion 312 of the compartment 310 may include an upper edge 312A, a lower edge 312B, and two side edges 312C. The cover portion 312 can be attached to the interior surface 304B of the sleeve 304 by stitching 314 along the side edges and the lower edge 312B of the cover portion 312. While the cover portion 312 is shown stitched to the interior surface 304B of the sleeve 304, the cover portion can be attached to the sleeve 304 by Velcro®, buttons, snaps, zipper or the like. The upward facing opening 324 of the compartment 310 may extend along the upper edge 312A of the cover portion 312. This configuration provides an access point for a user's hand into the glove 318 as the user's arm is inserted in sleeve 304. This configuration also eliminates the need for a lower sleeve opening and creates a convenient and discrete glove compartment within the sleeve 304.

Figure 4A:
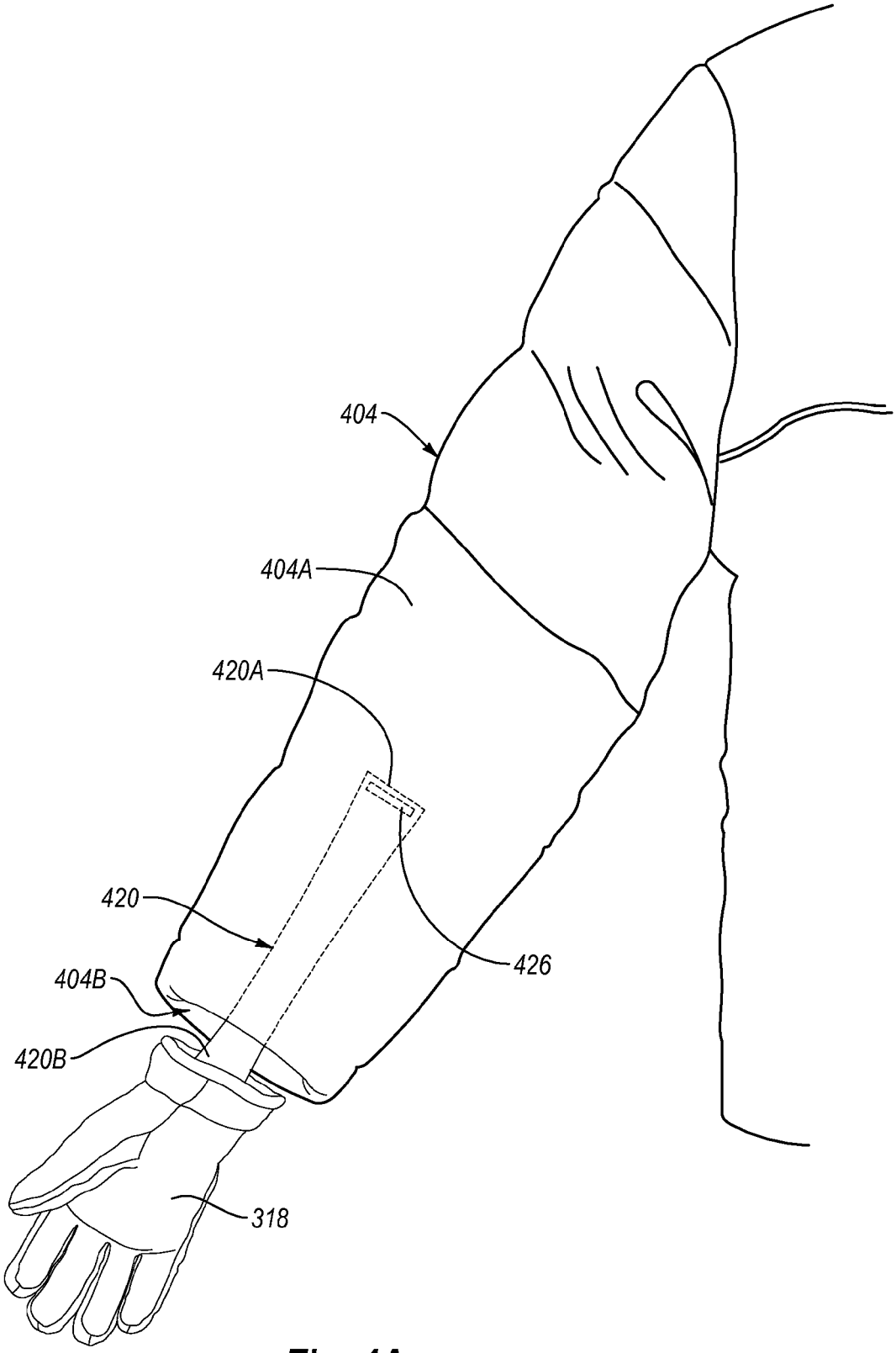
FIG. 4A illustrates an attachment element between a glove and a garment according to one example.

FIG. 4A illustrates an example attachment element extending from a sleeve 404. One will appreciated that the example attachment element shown may be used in combination with any of the example hand covering and garment combinations described above. The attachment element may comprise a fabric strip 420 having first end 420A stitched to an interior surface 404B of the sleeve 404 and a second end 420B fastened to an interior surface of a glove 418. The fabric strip 420 may be elasticized such that it can move between a first position wherein the fabric strip 420 and glove 418 are concealed within the sleeve 404 and second position wherein at least a portion of the fabric strip 420 and the glove 418 extend from the sleeve 404 as shown in FIG. 4A.

While the first end 420A is shown attached to the interior surface 404B of the sleeve 404, the first end 420A of the fabric strip 420 may be attached to the sleeve 404 at an exterior surface 404A, a top wall, a bottom wall, a side wall, or any other location on the sleeve suitable 404 to secure the fabric strip 420 to the sleeve 404. Likewise, while the second end 420B is shown fastened to an interior surface of the glove 418, the second end 420B of the fabric strip 420 may be attached to the glove 418 at an exterior surface, a palm wall, a backhand wall, a sidewall, or any other location on the glove 418 suitable to secure the fabric strip 420 to the glove 418. The fabric strip 420 may also be permanently or detachably attached to the glove 418 and/or the sleeve 404 with buttons, snaps, clips, adhesive, Velcro® or the like.

Figure 4B:
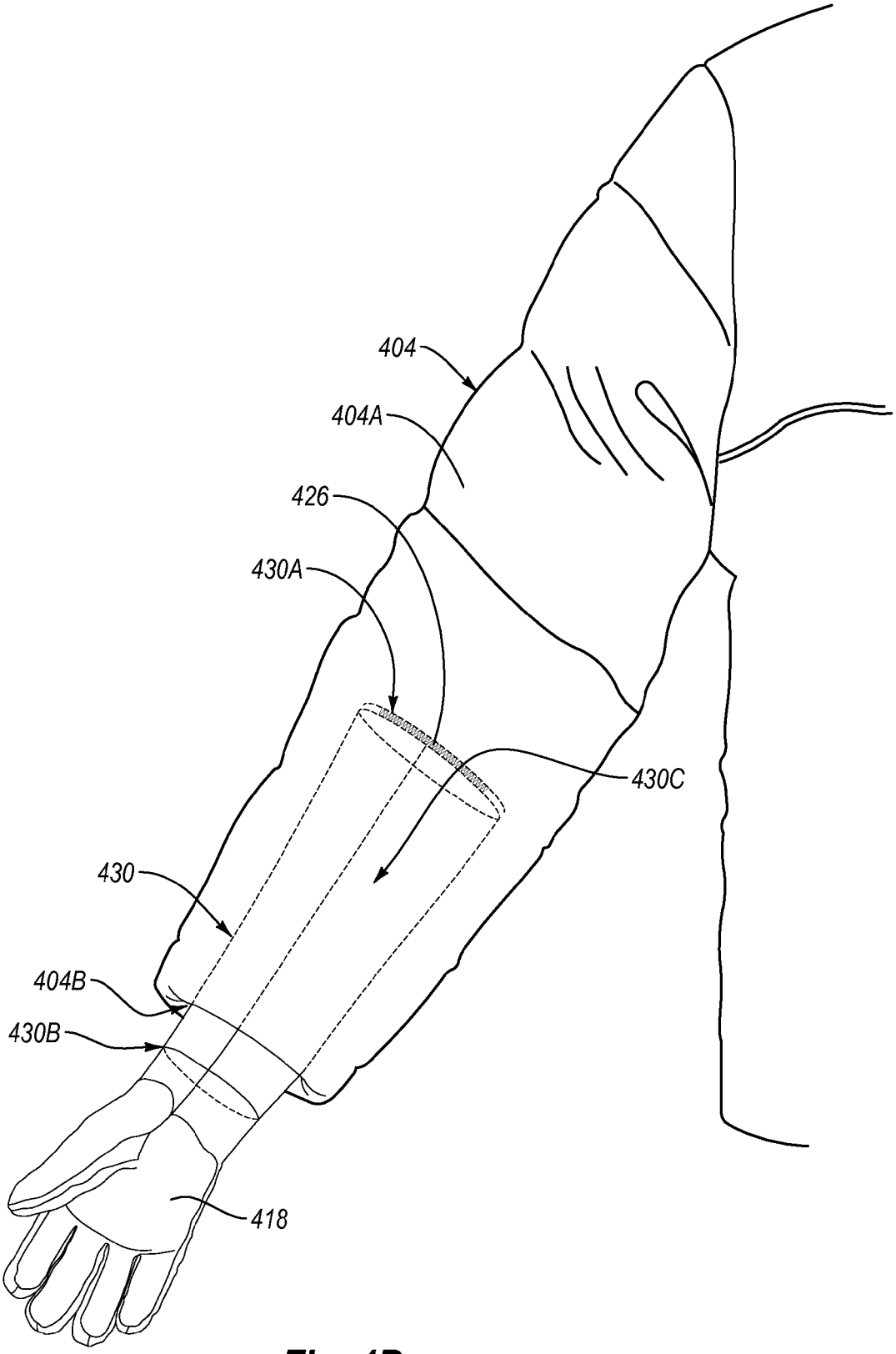
FIG. 4B illustrates an attachment element between the glove and the garment according to another example.

FIG. 4B shows yet another example attachment element extending from the sleeve 404. One will appreciated that the example attachment element shown in FIG. 4B may be used in combination with any of the example hand covering and garment combinations described above. The attachment element may comprise a fabric sleeve 430 having a first opening 430A, a second opening 430B, and a channel 430C extending therethrough. At least a portion of the periphery of the first opening 430A may be stitched to an inner surface 404B of the sleeve 404. The entire periphery of the second opening 430B may be stitched to the entire periphery of a cuff portion of the glove 418. The fabric sleeve 430 may be elasticized such that it can move between a first position wherein the fabric sleeve 430 and glove 418 are concealed within the sleeve 404 and second position wherein at least a portion of the fabric sleeve 430 and the glove 418 extend from the sleeve 404 as shown in FIG. 4B. The fabric sleeve 430 may be sized, shaped and configured to receive a hand and a part of a forearm of a user.

The first opening 430A may be attached to a top wall, a bottom wall, a side wall, or any other location on the sleeve suitable 404 to secure the fabric sleeve 430 to the sleeve 404. Likewise, the second opening 430B may be attached to the glove 418 at an exterior surface, an interior surface, a palm wall, a backhand wall, a sidewall, or any other location on the glove 418 suitable to secure the fabric sleeve 430 to the glove 418. Moreover, while the fabric sleeve 430 is shown attached to the sleeve 404 and the glove 418 with stitching, adhesive, buttons, snaps, clips, Velcro®, a zipper, or any other means suitable to attach the fabric strip 430 to the sleeve 404 and/or the glove 418 is possible.

In one embodiment, the fabric sleeve 430 may be attached to a dual opening compartment (not shown) and the glove 418. The compartment may configured to receive the glove 418 and the forearm of a user. The compartment may be located on an inner surface 404B of the sleeve 404 and have an upward facing opening and a downward facing opening. The entire periphery of the first opening 430B of the fabric sleeve 430 may be attached to the entire periphery of the upward facing opening of the compartment. The entire periphery of the second opening 430B of the fabric sleeve may be attached to the entire periphery of the cuff portion of the glove 418. The fabric sleeve 430 and the glove 418 may concealed within the compartment 310 in the first position and at least a portion of the fabric sleeve 430 and the glove 418 may extend from the sleeve 404 in the second position as shown in FIG. 4B.

Such a configuration allows a user to selectively put on a jacket or a coat and the glove 418 in a single motion. For example, the user can advance the user's hand and forearm through the sleeve 404, the upward facing opening of the compartment, and the fabric sleeve 430 to fit his or hand into the glove 418. The user can then continue to advance his or hand out the downward facing opening of the compartment to move the fabric sleeve 430 from the first position to the second position wherein at least a portion of the fabric sleeve 430 and the glove 418 extend from the sleeve as shown in FIG. 4B. When the user is finished using the glove, the user may simply withdraw the user's hand from the glove 418 and the upward facing opening of the compartment. The elasticity of the fabric sleeve 430 can then return the fabric sleeve 430 and the glove 418 to the first position wherein the fabric sleeve 430 and glove 418 are again concealed within the compartment. The user also has the option to extend the user's hand through the sleeve 404 without accessing the compartment or the glove 418.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A hand covering and garment combination, comprising:

at least one hand covering having a hand portion and a cuff portion;

a garment having a body portion and at least one sleeve, wherein the at least one sleeve includes an upper end, a free end that is opposite the upper end, and that further includes a cuff circumference, an outer surface, and inner liner surface, wherein the at least one sleeve is attached to the body portion at the upper end;

a compartment located on the inner liner surface of the at least one sleeve, the compartment configured to selectively receive and store the hand covering and to enable the hand covering to be introduced into the compartment from within the at least one sleeve, wherein the compartment includes:

a lower stitched seam parallel to the cuff circumference;

two side stitched seams perpendicular to the cuff circumference and the lower stitched seam, a first of the two side stitched seams being opposite a second of the two side stitched seams; and an upper boundary parallel to the cuff circumference and the lower stitched seam, wherein the upper boundary is configured as an opening to the compartment through which the hand covering is introduced into the compartment, and the compartment is oriented on the inner liner surface such that the upper boundary is closer to the upper end of the at least one sleeve than the lower stitched seam; and an attachment element having a first end attached to the garment and a second end attached to the hand covering, the attachment element being configured to secure the hand covering to the garment, the attachment element being further configured to retract the hand covering into the compartment during non-usage.

2. The hand covering and garment combination as recited in claim 1, further comprising a closure element configured to selectively secure the opening opened and closed.

3. The hand covering and garment combination as recited in claim 1, wherein the attachment element is attached within the compartment at a retractable dial configured to retract the attachment element into the compartment.

4. The hand covering and garment combination as recited in claim 1, wherein the hand covering and garment comprise the same material.

5. A garment comprising:

a body portion configured to cover at least a portion of a torso of a user;

at least one sleeve, wherein the at least one sleeve includes an upper portion, a free end opposite the upper end, a cuff circumference at the free end, an outer surface, and an inner surface, wherein the at least one sleeve is attached to the body portion at the upper end;

a compartment located on the inner surface of the at least one sleeve, wherein the compartment includes:

a lower stitched seam parallel to the cuff circumference;

two side stitched seams perpendicular to the cuff circumference and the lower stitched seam, a first of the two side stitched seams being opposite a second of the two side stitched seams; and an upper boundary parallel to the cuff circumference and the lower stitched seam, the upper boundary configured as an opening to the compartment, wherein the compartment is configured to selectively receive and store a hand covering through the upper boundary from within the at least one sleeve;

wherein the upper boundary is located closer to the upper end of the at least one sleeve than the lower stitched seam, and the two side stitched seams extend from the upper boundary to the lower stitched seam; and a cord having a first end attached within the compartment and a second end configured to be attached to the hand covering, the cord being configured to secure the hand covering to the garment.

6. The garment as recited in claim 5, wherein the cord is attached within the compartment at a retractable dial configured to retract the cord into the compartment.

7. The garment as recited in claim 5, further comprising:

a second sleeve, wherein the second sleeve includes a second upper portion, a second free end opposite a second upper end, and a second inner surface, and a second cuff circumference at the second free end, wherein the second sleeve is attached to the body portion at the second upper end;

a second compartment located on the second inner surface of the second sleeve, the second compartment configured to selectively receive and store a second hand covering, and configured to enable the second hand covering to be introduced into the second compartment from within the second sleeve; and a second cord having a first end attached within the second compartment and a second end configured to be attached to the second hand covering and to secure the second hand covering to the garment.

* * * * *